US008388029B2

(12) United States Patent
Pecoul et al.

(10) Patent No.: US 8,388,029 B2
(45) Date of Patent: Mar. 5, 2013

(54) LOCK HAVING A SINGLE SWITCH

(75) Inventors: Jean-christophe Pecoul, Créteil Cedex (FR); Christian Wattebled, Créteil Cedex (FR)

(73) Assignee: Valeo Securite Habitacle, Creteil Cedex (FR)

( * ) Notice: Subject to any disclaimer, the term of this patent is extended or adjusted under 35 U.S.C. 154(b) by 825 days.

(21) Appl. No.: 11/885,603

(22) PCT Filed: Feb. 22, 2006

(86) PCT No.: PCT/EP2006/060176

§ 371 (c)(1), (2), (4) Date: Aug. 31, 2007

(87) PCT Pub. No.: WO2006/092372

PCT Pub. Date: Sep. 8, 2006

(65) Prior Publication Data

US 2008/0136196 A1 Jun. 12, 2008

(30) Foreign Application Priority Data

Mar. 1, 2005 (FR) ..... 05 02048

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23

See application file for complete search history.

(56) References Cited

U.S. PATENT DOCUMENTS

| | | | | |
|---|---|---|---|---|
| 4,298,223 A | | 11/1981 | Raffelsiefer et al. | |
| 4,824,152 A | * | 4/1989 | Jeavons | 292/216 |
| 4,984,385 A | * | 1/1991 | DeLand | 49/280 |
| 5,785,364 A | | 7/1998 | Kleefeldt et al. | |
| 5,979,951 A | * | 11/1999 | Shimura | 292/216 |
| 6,175,202 B1 | | 1/2001 | Weyerstall et al. | |
| 6,378,920 B1 | * | 4/2002 | Ostrowski et al. | 292/216 |
| 6,866,311 B2 | * | 3/2005 | Spurr et al. | 292/216 |
| 6,886,869 B2 | * | 5/2005 | Martinez et al. | 292/216 |
| 2005/0001437 A1 | | 1/2005 | Brose | |

FOREIGN PATENT DOCUMENTS

FR 2 778 939 5/1998

OTHER PUBLICATIONS

International Search Report w/ English Translation for PCT/EP2006/060176 mailed Jun. 7, 2007 (4 pages).

* cited by examiner

*Primary Examiner* — Carlos Lugo

*Assistant Examiner* — Mark Williams

(74) *Attorney, Agent, or Firm* — Osha Liang LLP

(57) ABSTRACT

The invention concerns a lock provided with a single switch to indicate the "open" or "closed" state of said lock, comprising an actuator (5, 6) acting on a kinematic chain (7) to produce the functions of the lock, a switch (19) adapted to indicate the states of the lock, a double-notched closure (2, 3) bolt (1), a pawl (9) including a pawl tooth (4) designed to be urged into engagement with the first (2) or second (3) notch for closing the bolt (1). The invention is characterized in that it comprises a mobile cam (12) for actuating the switch, said actuating cam (12) being mobile under the action of the bolt (1) and/or of the pawl (9) during the opening and/or closing phase of the lock.

19 Claims, 12 Drawing Sheets

LOCK HAVING A SINGLE SWITCH

Figure 1:
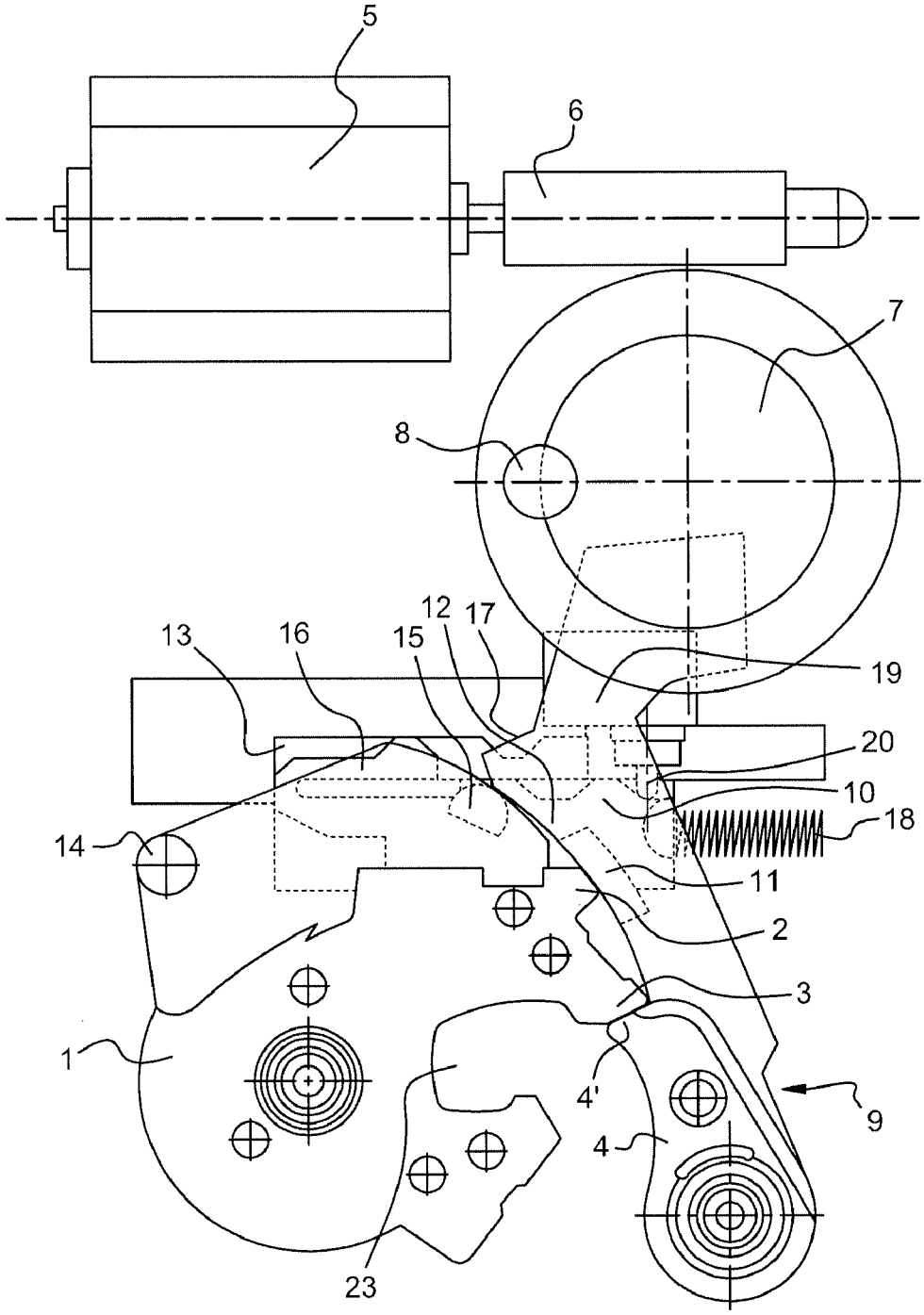

The invention relates to a lock, electric or mechanical, for assistance in the opening/closing of an associated leaf, and/or for the locking/release of said lock. It relates, in particular, to a lock boasting a single switch designed to indicate the "open" and "closed" states of the lock.

For the management of the functions of the lock, viz., in particular, the opening/closing assistance or the locking/release, it is essential to be precisely aware of the "open" and "closed" state of the lock.

In the prior art, locks, for example electric locks, boasting two switches are known. Such an electric lock is described in document FR 2778939 in the name of the Applicant. In such a lock, a switch cooperates with the bolt and another switch cooperates with the pawl, so that it is possible to know extremely reliably the "open" and "closed" state of the lock. In fact, with the switch connected to the pawl, the information relating to the opening state of the lock, depending on the position of the pawl tooth in engagement, or in cooperation, with the second closing notch of the bolt, is obtained.

This type of lock allows reliable information to be obtained as regards the state of the lock, but it requires the use of two switches and the whole of the dedicated management electronics, which is particularly costly and bulky.

In the prior art, locks containing a single switch are also known, such as in document U.S. Pat. No. 6,175,202. In this lock, the single switch cooperates with the bolt, so that reliable information relating to the opening state of the lock, but no reliable information as regards the closing state of the lock, is obtained.

At present, therefore, there is no lock on the market which boasts just a single switch for indicating precisely and reliably the "open" and "closed" state of the lock.

The object of the present invention is to eliminate the drawbacks of the devices of the prior art by proposing a lock boasting a single switch and a particularly simple and inexpensive mechanical means capable of allowing the precise indication of the states of the lock.

The present invention thus relates to a lock boasting a single switch for indicating the "open" or "closed" state of said lock, comprising an actuator acting upon a kinematic chain so as to realize the functions of the lock, a switch capable of indicating the states of the lock, a bolt having two closing notches, a pawl containing a pawl tooth designed to engage with the first or the second closing notch of the bolt, characterized in that it comprises a mobile switch-actuating cam, said actuating cam being displaceable under the action of the bolt and/or of the pawl during the opening and/or closing phase of the lock.

Advantageously, during the opening/closing phases, the bolt and the pawl cooperate with the cam.

According to one embodiment, during the opening phase the pawl cooperates first with the cam, while during the closing phase the bolt cooperates first with the cam.

By virtue of the invention, it is now possible to obtain the true information as regards the "open" and "closed" state of the lock owing to a single switch.

In the remainder, the function of the described lock is to assist the opening of a vehicle leaf, such as a door. Of course, the lock according to the invention is not limited to the function of assisting the opening/closing of a leaf and will also be able to realize other functions, such as locking/release.

The invention is described in greater detail below with the aid of figures representing only preferred embodiments of the invention.

Figure 2:
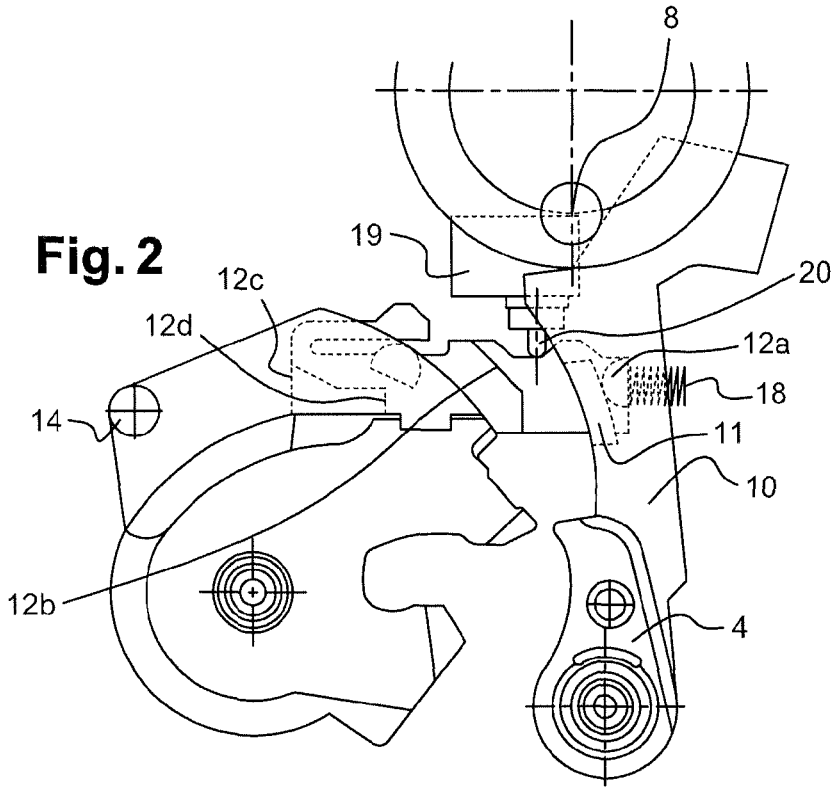
Figure 3:
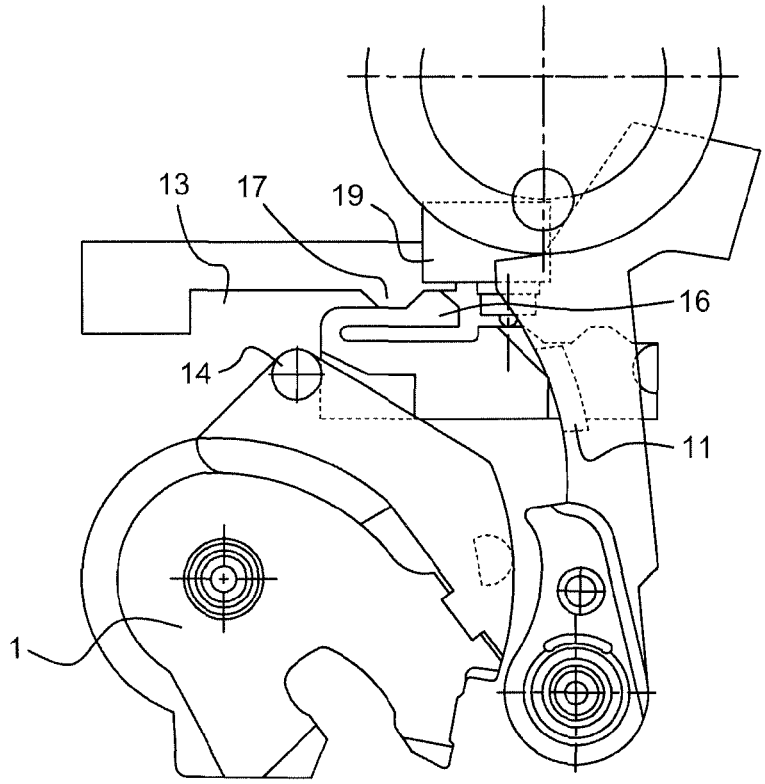
Figure 4:
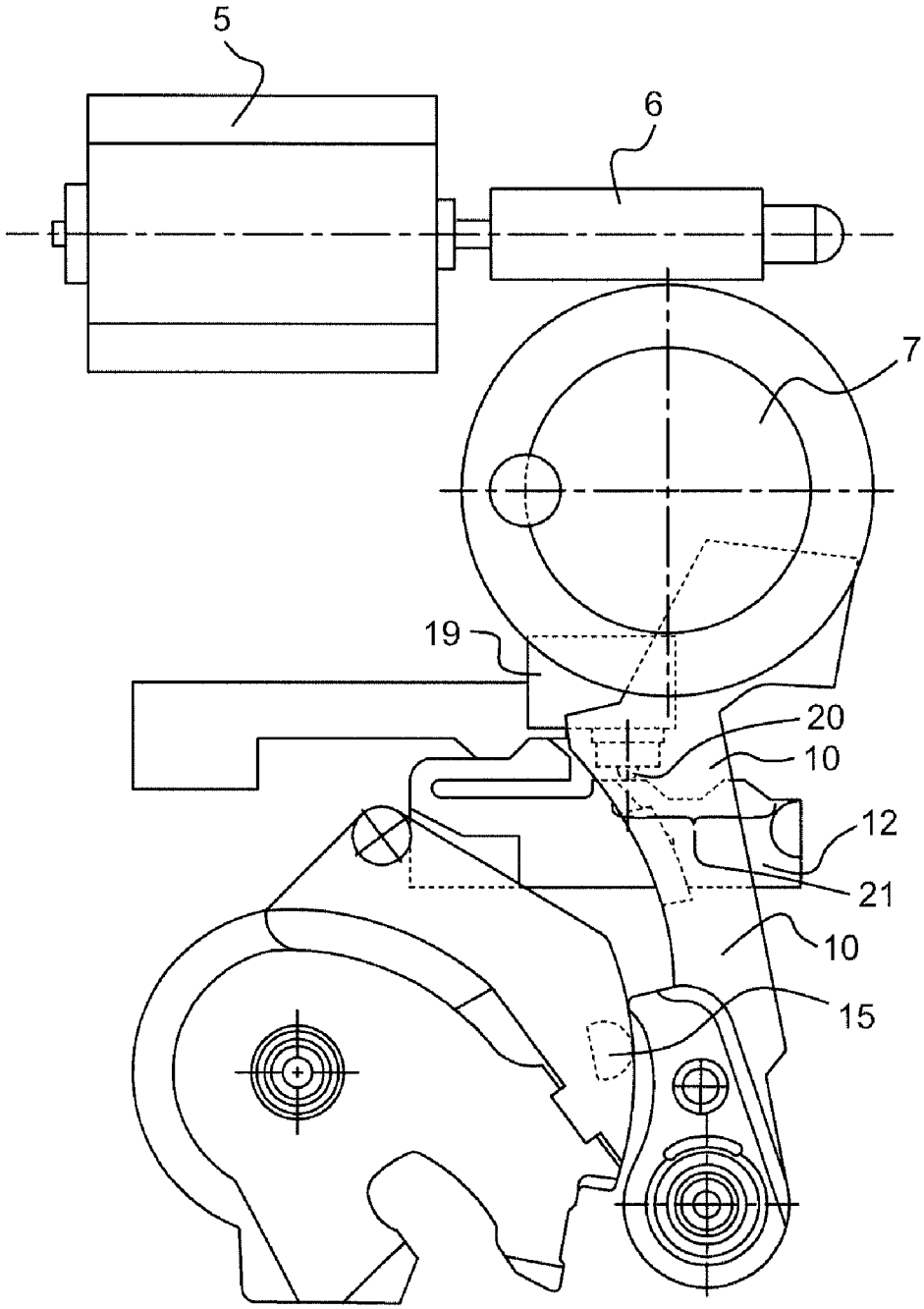
Figure 5:
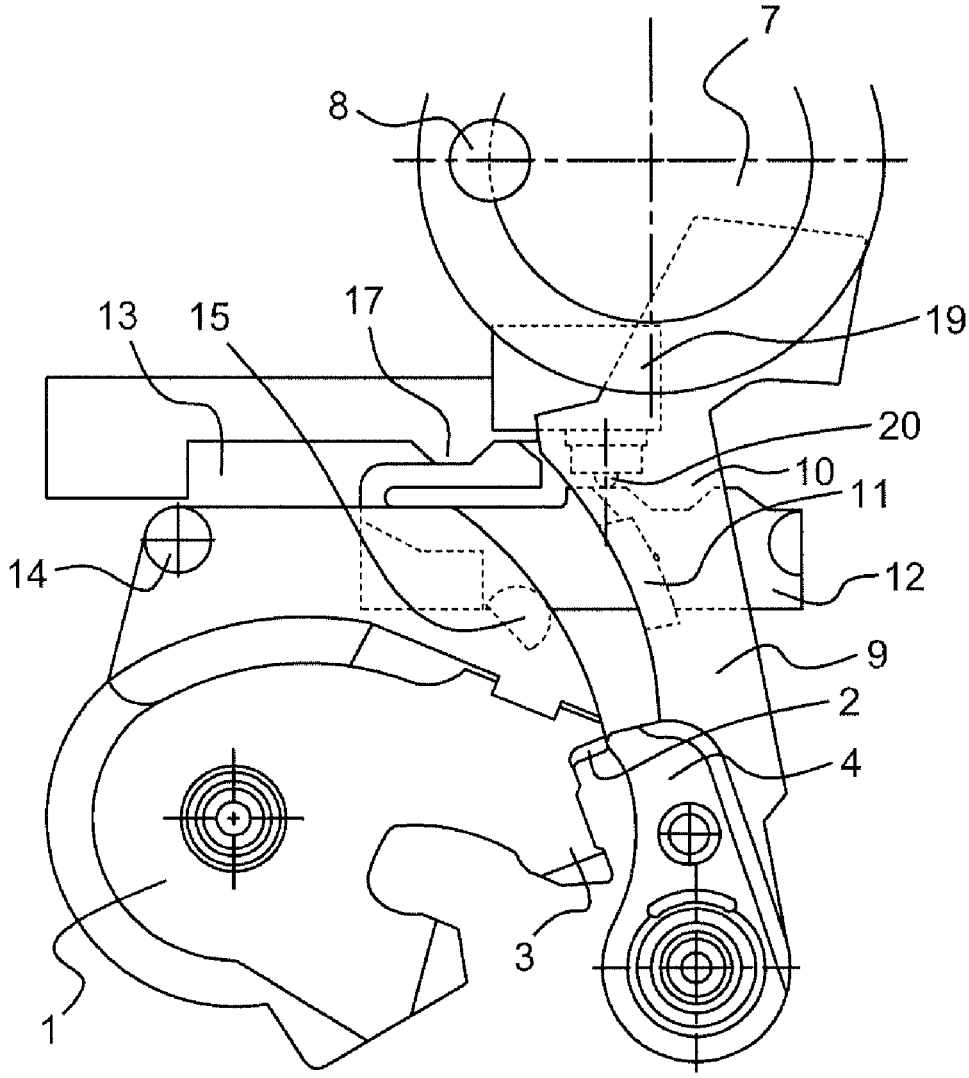
Figure 6:
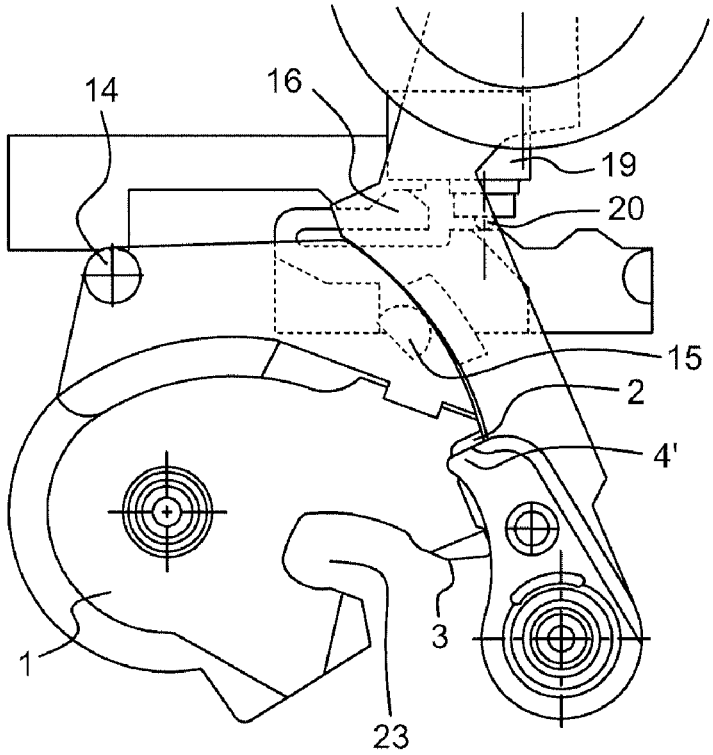
Figure 7:
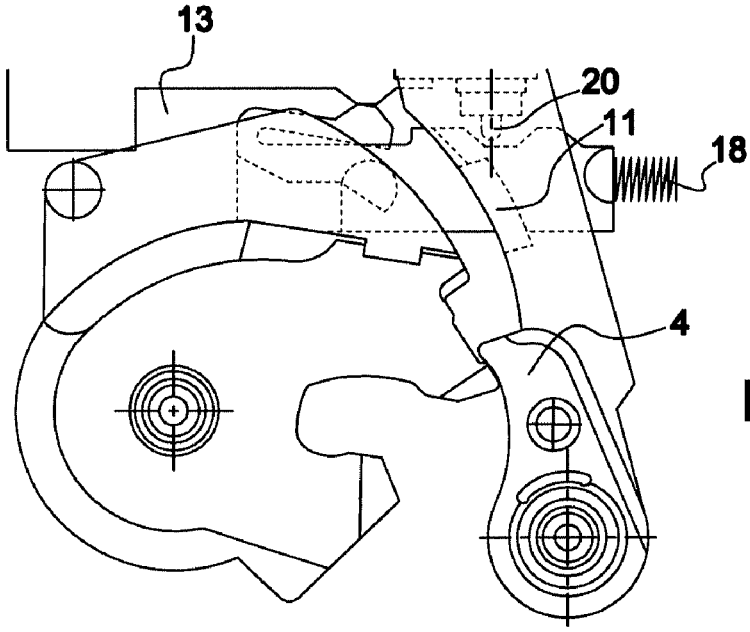
Figure 8:
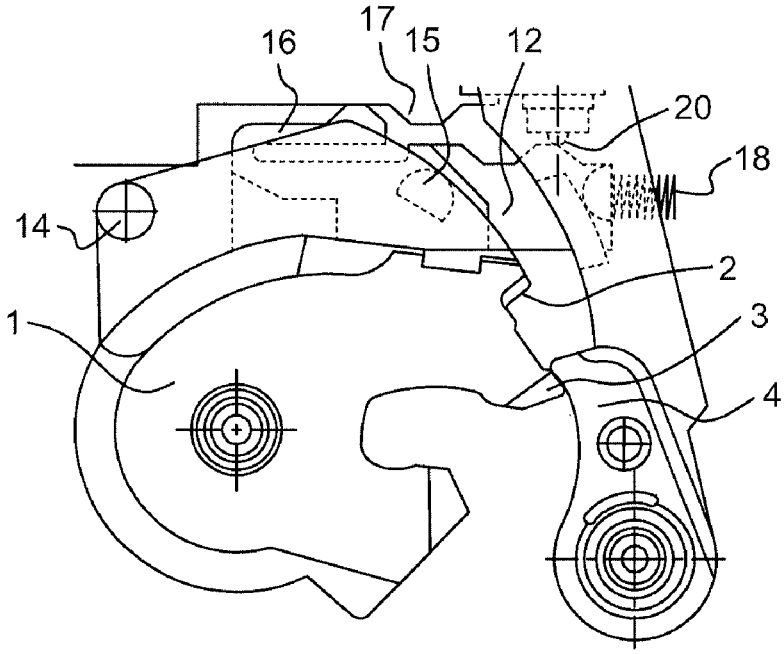
Figure 9:
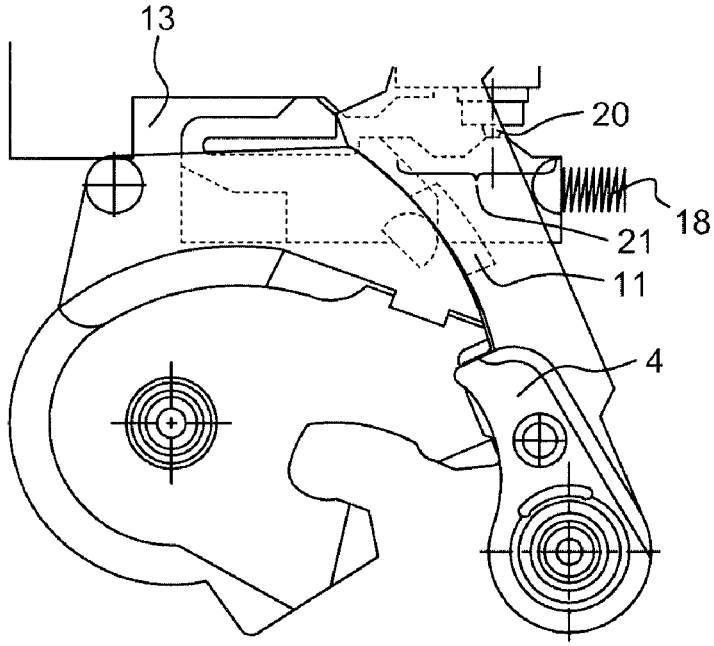
Figure 10:
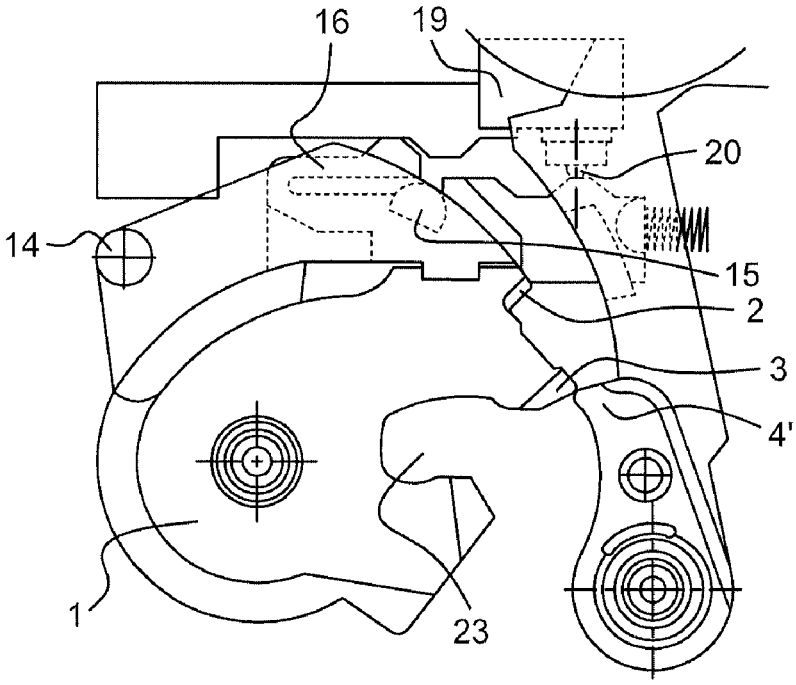
Figure 11:
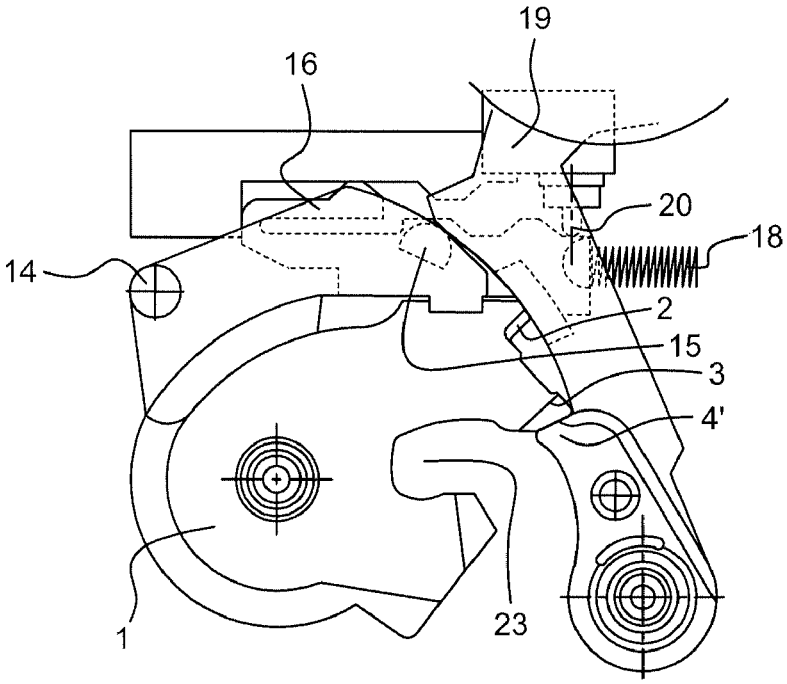
Figure 12:
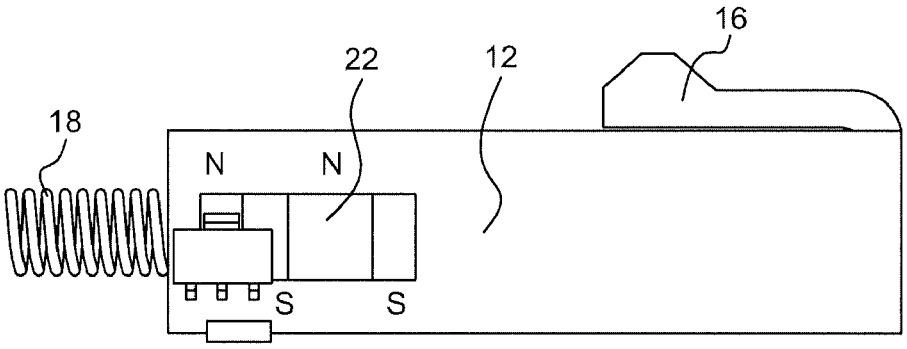
Figure 13:
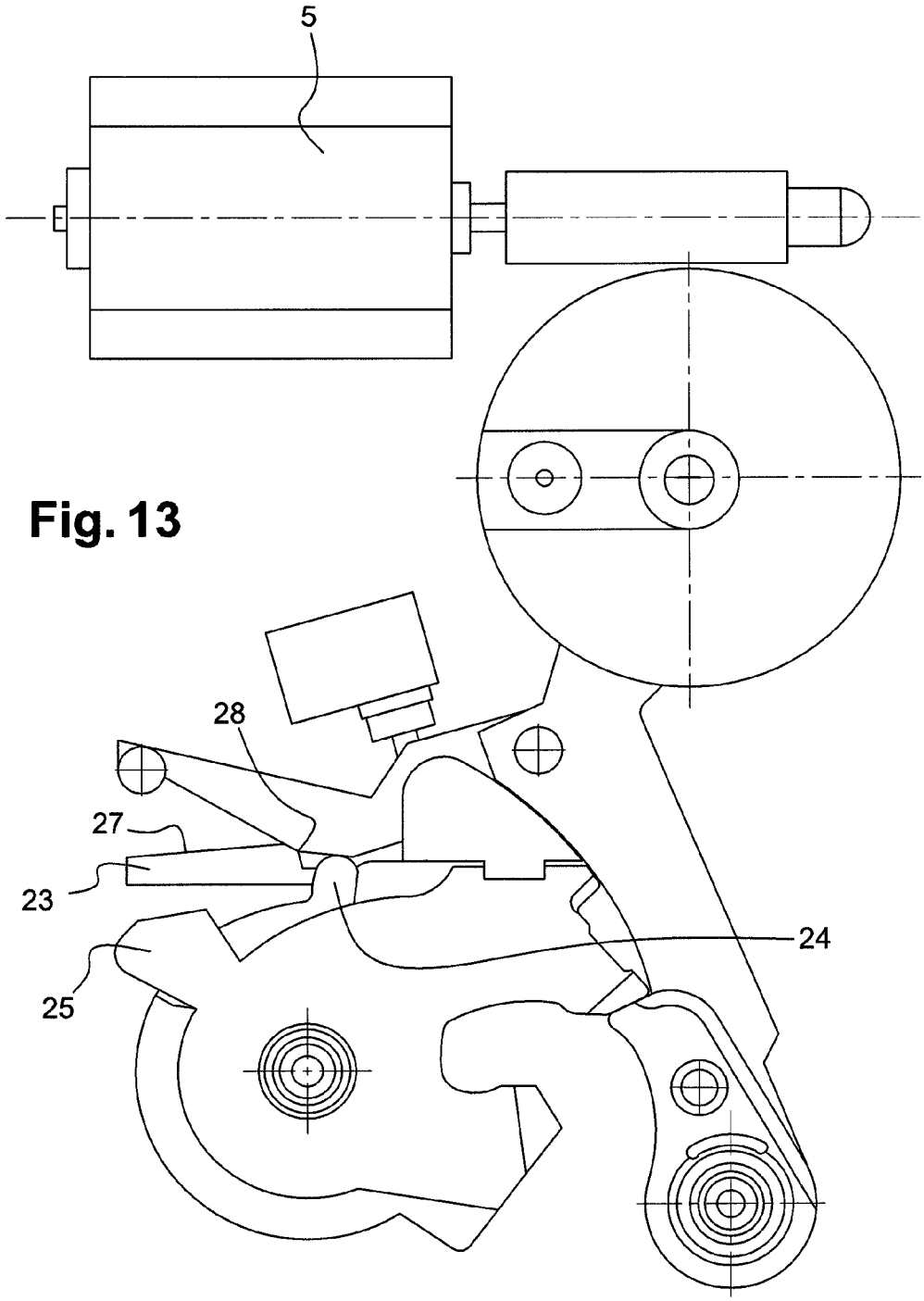
Figure 14:
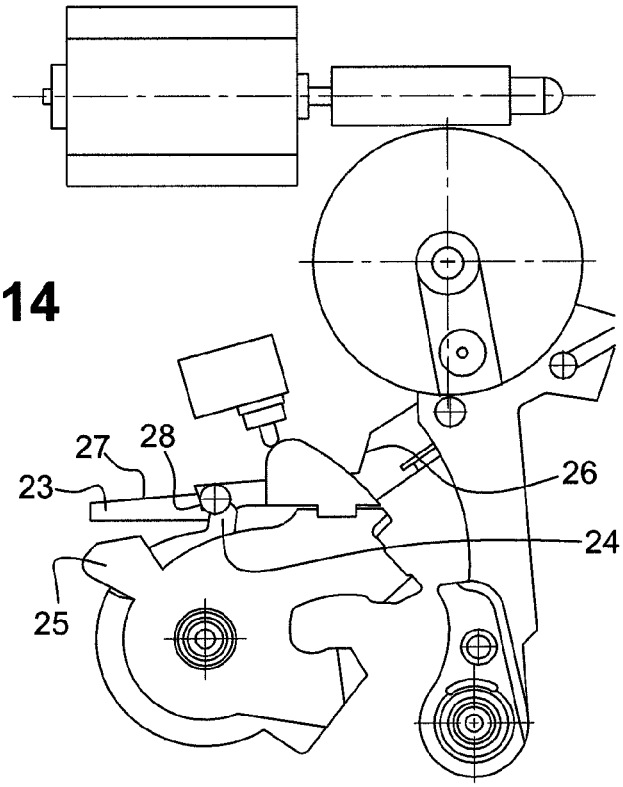
Figure 15:
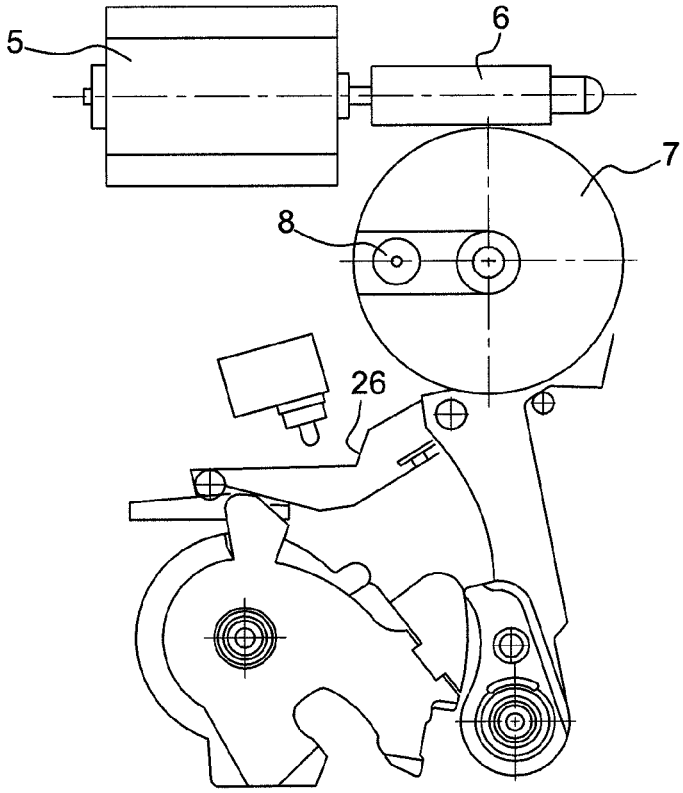
Figure 16:
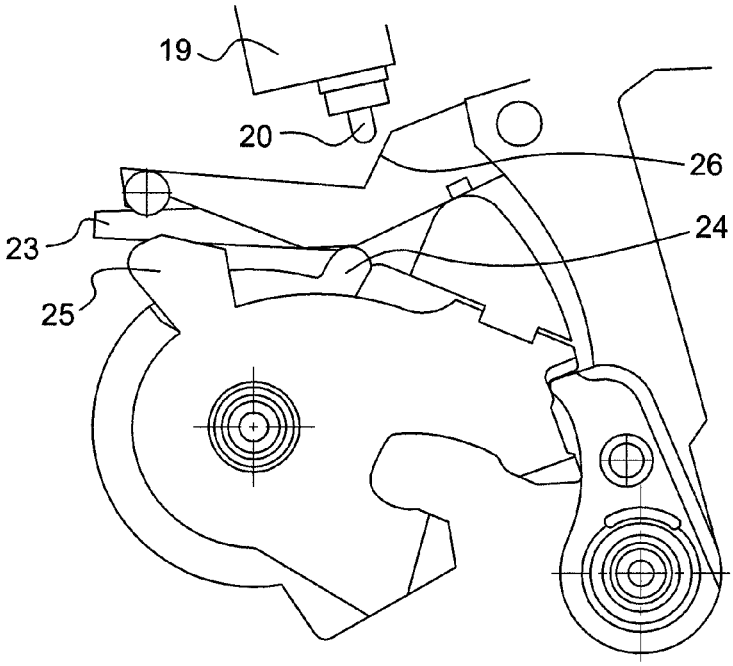
Figure 17:
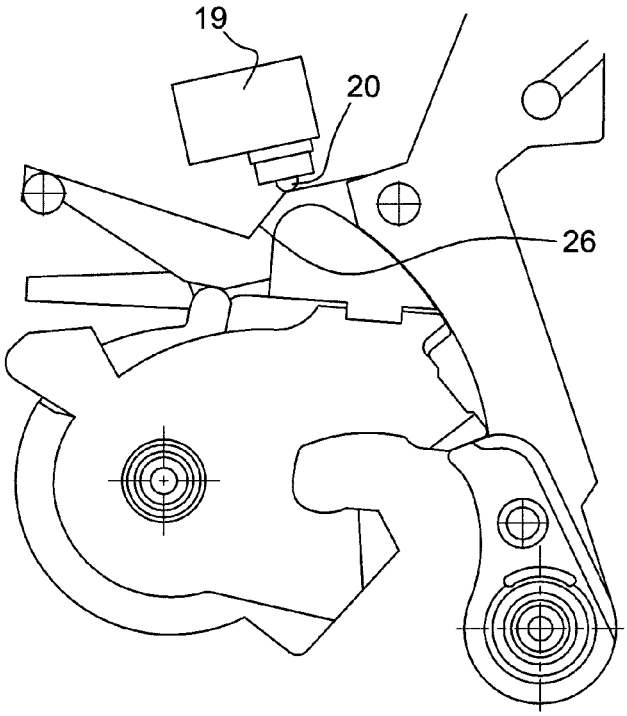

FIG. 1 is a diagrammatic view of the whole of the elements of a lock according to the invention, FIG. 2 is a diagrammatic view of a lock according to the invention following a command of the electric actuator for the opening of the leaf, FIG. 3 is the same diagrammatic view, temporally following FIG. 2, during an opening phase, illustrating the different elements of the lock according to the invention when the bolt is in the opening position, FIG. 4 is a diagrammatic view, temporally following FIG. 3, at the end of the opening phase, when the bolt is in the opening position, the pawl being released and the kinematic chain being returned into its initial position, FIG. 5 is a diagrammatic view of the lock according to the invention just after a manual closing action of the leaf, the bolt being manually driven by the striker toward its closing position, FIG. 6 is a diagrammatic view, temporally following FIG. 5 during a closing phase, of the lock as the first notch of the bolt is passed, FIG. 7 is a diagrammatic view of the lock, temporally following FIG. 6 during the closing phase, the cam being released between the first and the second closing notch of the bolt, FIG. 8 is a diagrammatic view of the lock, temporally following FIG. 7 during the closing phase, the cam being driven by a return spring, FIG. 9 is a diagrammatic view of the lock, temporally following FIG. 8 during the closing phase, on the assumption that the pawl tooth resumes butting contact or cooperation with the first closing notch of the bolt, FIG. 10 is a diagrammatic view of the lock, temporally following FIG. 8, the pawl tooth entering into cooperation or butting contact with the first closing notch of the bolt, FIG. 11 is a diagrammatic view of the lock previously represented, temporally following FIG. 10, at the end of the closing phase, FIG. 12 is a diagrammatic view of an alternative solution for the switch and the cam, in which the special geometry of the cam is replaced by a multipolar magnet and the switch is a Hall effect sensor, FIG. 13 illustrates a second embodiment of a lock according to the invention, FIG. 14 illustrates the lock of the second embodiment when the pawl tooth is released from its engagement with the bolt under the action of the actuating kinematic chain, FIG. 15 illustrates the lock of the second embodiment when said lock is in the opening position, the bolt being in the extreme release position of the striker (not represented), FIG. 16 illustrates the lock of the second embodiment when the pawl tooth is in protuberance with the first closing notch of the bolt, FIG. 17 illustrates the lock of FIGS. 13 to 16 when said lock is in the closing position, the pawl tooth being in cooperation with the second closing notch of the bolt.

Figure 18:
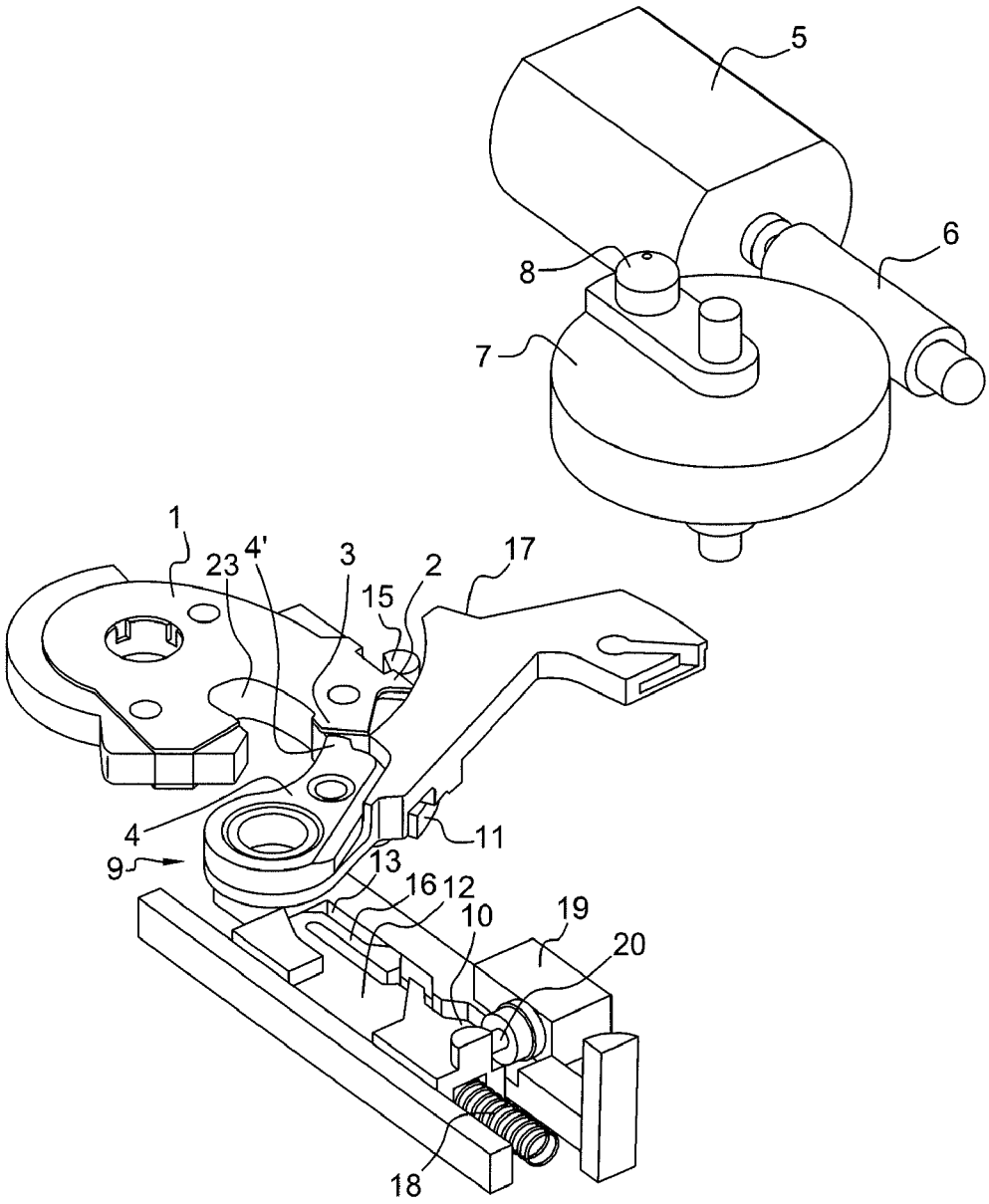

FIG. 18 provides an exploded perspective view of the lock in accordance with one or more embodiments of the invention.

In order to illustrate the present invention, the two embodiments are shown with an electric lock, that is to say the kinematic chain controlling the displacement of the pawl, and hence the opening of the bolt, is actuated by an electric motor (electric motor 5 and motor shaft 6 in the appended figures). Of course, the invention is not intended specifically for use for an electric lock and can function perfectly well in or for a mechanical lock, that is to say a lock in which the kinematic chain is entirely mechanical. In this case, the actuating means for the kinematic chain designed to act upon the pawl is/are mechanical and not electric.

Moreover, as can be seen in the appended figures, the figures follow on from one another in an opening phase, then in a closing phase, from an initial state, represented in FIG. 1, in which the electric lock is in the "closed" position.

Moreover, it is important to note that the present invention is intended essentially for a lock equipped with a bolt 1 boasting two closing notches 2 and 3; the "closed" position for the lock being that in which the pawl tooth 4 cooperates in butting arrangement with the second closing notch 3 of the bolt 1 in order to block the latter 1.

In FIG. 1, the electric motor 5, from which there extends a rotary motor shaft capable of setting in rotation a kinematic chain, can be seen. In the example chosen here to illustrate the invention, the assembly formed by the motor 5 and its shaft 6 forms the actuator of the lock, while the kinematic chain 7 consists of a wheel which is rotationally movable under the action of the motor shaft 6 and contains at least one pin 8 extending perpendicularly to the plane of rotation of the free wheel 7. Through rotation of the free wheel 7, the pin 8 enters into cooperation with the pawl 9 of the lock.

The pawl 9 of the lock comprises of a substantially boot-shaped or L-shaped part 10, the end of which cooperates with the pin 8. In fact, the pin 8, upon the rotation of the movable wheel 7, enters into contact with the end of the boot-shaped part 10 in order to drive the pawl 9 in the clockwise direction so as to move it away from or remove it from the bolt 1. In fact, the rotationally movable pawl 9 traditionally comprises a return spring, not represented in the appended figures, exerting a force which tends to return the pawl 9 against the pawl 1, either in the trigonometric direction or counterclockwise. The pawl 9 comprises, in addition to the boot-shaped part 10, an integral part 4 forming the pawl tooth 4, one end 4' of which is designed to engage with the closing notches 2, 3 of the bolt 1 so as to block the latter 1. The pawl 9 here comprises a stop 11, extending perpendicularly to the plane of rotation of the pawl 9, designed to cooperate with the face 12*a* of the cam 12.

The bolt 1 of the lock consists of a traditional bolt, apart from the fact that it boasts two protuberances 14, 15 extending perpendicularly to the plane of rotation of the bolt 1, capable of cooperating with the cam 12 to push the latter 12 so as to displace it toward the pawl 9. The rotationally movable bolt 1 here comprises two closing notches 2, 3 capable of cooperating with the end 4' of the pawl tooth 4. Likewise traditionally, the bolt 1 boasts a return spring, not represented in the appended figures, which tends to return the bolt 1 into the release position of the striker, not represented in the appended figures, or into an opening position, that is to say tends to turn the bolt 1 in the clockwise direction. The lock according to the invention comprises a mobile cam 12 accommodated or disposed in a recess 13, for example made in a portion of the lock housing, not represented in the appended figures. The provided recess 13 allows the linear, or translational, displacement of the cam 12 to be permitted, owing to the fact that this recess 13 extends substantially linearly.

The cam 12 is subjected to the action of a permanent force tending to return said cam 12 into an initial position. It will be noted that in the example chosen to illustrate the invention, the initial position of the cam 12 is the position in which the cam 12 butts against one end of the recess 13 of the housing.

The cam 12 contains a flexible tongue 16 cooperating with a portion 17 of the recess of the housing. The cam 12 is subjected to the action of a spring 18 designed to return the cam 12 into its initial position, viz. its position when the lock is closed, the cam 12 butting against a wall of the recess 13. The spring 18 is situated close to the pawl 9, so that its action tends to move the cam 12 away from the pawl 9. Moreover, in the example chosen to illustrate the invention in FIGS. 1 to 11, the recess 13 comprises an advanced portion 17, or stop, designed to cooperate with the flexible tongue 16 of the cam 12. The cooperation between the portion 17 of the recess 13 and the flexible tongue 16 of the cam 12 allows the latter 12 to be blocked, as long as a sufficient force has not been transmitted to the cam 12 such that the flexible tongue 16 yields, or bends, to enable the cam 12 to continue its displacement in one direction or other beyond the portion 17.

It will be noted that the displacement of the cam 12 is ensured either by the bolt 1, via one of its protuberances 14 or 15, or by virtue of its return spring 18, or by the protuberance 11 of the pawl boot.

The lock according to the invention comprises a single switch 19, fixed in or on the housing of the lock, designed to advise of the opening or closing state of the lock, that is to say sometimes the position of the bolt 1 and sometimes that of the pawl 9. In the example chosen to illustrate the invention in FIGS. 1 to 11, the switch 19 comprises a mobile plunger 20 capable of occupying a retracted and an extended position under the action of the cam 12, each of its two positions of the plunger 20 defining a state of the switch 19. The switch 19 thus comprises a plunger 20 cooperating with a part of the surface of the actuating cam 12 for its activation/deactivation, or its change of state. The plunger 20 is subjected to the action of a spring, not represented in the appended figures, disposed in the switch 19, which spring tends to make it emerge from its recess into the extended position. Moreover, the part of the cam 12 likely to come into contact with the plunger 20 boasts a particular geometry, for example in the shape of a wave or of undulations, so that at the peak of a wave or of an undulation the plunger 20 is depressed in the retracted position and when the plunger 20 is in contact with the cam 12 at the trough of the wave or of the undulation the latter 20 is released into the extended position, or into the extreme release position outside the switch 19.

In the embodiment of the switch 19 illustrated in FIG. 12, the switch 19 consists of a Hall effect sensor. In this case, the particular geometry of the part 21 of the cam 12 designed to come into contact with the plunger 20 is clearly no longer necessary, so that this part 21 of the cam 12 can have any shape whatsoever, but must comprise a multipolar magnet 22 or a plurality of reverse polarity magnets arranged side by side.

In FIG. 1, the lock is in the closed position, that is to say that the pawl tooth 4 cooperates in butting arrangement with the second closing notch 3 of the bolt 1.

The actuator starts up and the motor shaft 6 turns in one direction so that the pin 8 turns in the trigonometric direction in the direction of the boot 10 of the pawl 9. The pin 8 enters into contact with the boot 10 and continues its rotation in the trigonometric direction, driving the pawl 9, which moves away from the bolt 1 so that the pawl tooth 4 disengages the second closing notch 3 of the bolt 1, as illustrated in FIG. 2. The cam 12 having been displaced by dint of the contact between the protuberance 11 of the boot and the face 12*a* of the cam, the switch 19 reverts to its initial state after a brief period in an activated state, identical to its position when the lock is closed, the plunger 20 having fully emerged outside the housing of the switch 19, that is to say that it rests in contact with the trough of the wave-shaped or undulation-shaped part 21 of the cam 12.

The released bolt 1 then turns in the clockwise direction under the action of its return spring and releases the striker, not represented in the appended figures. Almost at the end of its rotation, the protuberance 14 of the bolt 1 comes into contact with the cam 12, more precisely the side 12*c* of the cam 12, and pushes it into its recess 13, so that the cam 12 is displaced in translation in the direction of the pawl 9. Upon this displacement of the cam 12, the plunger 20 returns into the housing of the switch 19 under the action of the contact with the wave-shaped or undulation-shaped part 21 of the cam 12. In fact, when the bolt 1 is in the opening position, the plunger 20 is in contact with a peak of the wave-shaped or undulation-shaped part 21 of the cam 12, so that, since the plunger 20 is depressed, or in the retracted position, the switch 19 changes state. This change of state of the switch 19 makes it possible to indicate or know that the lock is in the opening position.

It will be noted that the wave-shaped or undulation-shaped part 21 of the cam 12 has between a trough and a following peak an inclined part, so that the plunger 20 is gradually depressed when it passes from a trough to a peak or, conversely, gradually emerges from the housing of the switch 19 when it passes from a peak to a trough of the wave-shaped or undulation-shaped part 21. By virtue of the particular geometry of the cam 12 and/or of the position of the protuberance 14 of the bolt 1, this allows a precise and desired control of the instant at which the plunger 20 will be depressed such as to switch over the switch 19, thus indicating the opening state of the lock. In order to modify the triggering of the switch 19, or its change of state, it will thus be sufficient to dispose the protuberance 14 on the bolt 1 at a precise location, since it is the protuberance 14 of the bolt 1 which displaces the cam 12 and thus brings about the change of state of the switch 19.

In other words, it is clearly apparent that in the opening phase of the lock it is the bolt 1 which defines, as a function of its position, the moment at which it will be indicated that the lock is open.

As can be seen in FIG. 3, it will be noted that the flexible tongue 16 has passed the protruding portion 17 of the recess 13 in the course of its displacement under the action of the protuberance 14 of the bolt 1.

In FIG. 4 are illustrated the elements of the lock according to the invention when the latter is in the opening position, the wheel 7 having performed a rotation such as to return the pin 8 into its initial position, that is to say that the pin 8 reverts to its position close to the boot 10 of the pawl 9. In fact, the electric motor 5 continues to function for a defined time (delay time), then, after its stoppage, the motor 5 is in short circuit, which promotes the braking of the kinematics of the wheel 7. The boot 10 of the pawl 9, under the action of its return spring, comes to bear again against the bolt 1, more precisely, as illustrated in FIG. 4, it is the pawl tooth 4 which comes into contact against the bolt 1.

As can be seen in FIG. 5, the switch 19 remains in its state indicating the opening of the lock, while the bolt 1 turns in the trigonometric direction under the action of the striker bearing upon a face of the recess 23 of the bolt 1. In FIG. 5, the bolt 1 is turned up to the level at which the pawl tooth 4 is almost in cooperation with the first closing notch 2 of the bolt 1. Between the position bolt 1 open and the first closing notch 2, the pawl 9 thus remains bearing upon the bolt 1.

When the bolt 1 pursues its rotation, during the opening phase, the pawl tooth 4 is now butting against the first closing notch 2 of the bolt 1. At this moment, a second protuberance 15 of the bolt 1, extending perpendicularly to the plane of rotation of the bolt 1, comes into contact with a surface 12*d* of the cam 12, via said protuberance 15. By dint of the rotation in the trigonometric direction of the bolt 1, this second protuberance 15 of the bolt 1 acts upon the cam 12 so as to return it toward its initial position occupied when the lock is in the closing position, i.e. in order to move it away from the pawl 9. The flexible tongue 16 comes to butt against the portion 17 of the recess 13.

The trigonometric rotation of the bolt 1 drives the cam 12, and hence the flexible tongue 16, so that the latter 16 passes the portion 17. After the first closing notch 2 of the bolt 1 has been passed, the bolt 1 releases the cam 12, that is to say that the second protuberance 15 is no longer in contact with the cam 12. As can be seen in FIG. 7, it will be noted that the plunger 20 then proceeds to emerge gradually from the housing of the switch 19, for the translation of the cam 12 brings the plunger 20 into contact with a trough of the undulation-shaped or wave-shaped part 21 of the cam 12. As the plunger 20 passes from its retracted to its extended position, the switch 19 changes state, indicating the passage of the pawl 9 opposite the first closing notch 2 of the bolt 1.

The return spring 18 acts to return the cam 12 toward its initial position, i.e. at a distance from the pawl 9. This displacement of the cam 12 results in the plunger 20 climbing back into the retracted position, for the latter is once again in contact with a peak of the undulation-shaped or wave-shaped part 21 of the cam 12, whereby a change of state of the switch 19 is produced, indicating that the lock is open, that is to say that the pawl 9, or its tooth 4, is not cooperating with the second closing notch 3 of the bolt 1.

At this stage, as illustrated in FIG. 8, the stop 11 of the pawl 9, more precisely the stop 11 of the boot 10 of the pawl 9, comes to butt against a surface 12*a* of the cam 12. This contact between the pawl 9 and the cam 12 has the effect of stopping the displacement of the cam 12 toward its initial position under the action of its return spring 18.

Thus, if the pawl 9, or more precisely the pawl tooth 4, falls back to butt against the first closing notch 2 of the bolt 1, as illustrated in FIG. 9, the switch 19 will still indicate that the door is open, the cam 12 having been returned to its initial position under the action of the protuberance 15 of the bolt 1 in contact with its face 12*b*.

In fact, if the pawl tooth 4 cooperates with the first closing notch 2 of the bolt 1, it is generally considered that the door is not closed. It will be noted that the falling back of the pawl 9 to the first closing notch 2 of the bolt 1 permits the displacement of the cam 12 toward its initial position only by a minimum distance for which the plunger 20 still remains in contact with a peak of the undulation-shaped or wave-shaped part 21 of the cam 12, so that the switch 19 does not change state, still indicating that the lock is open.

In FIG. 10, the instant is illustrated at which the pawl tooth 4 enters into cooperation with the second closing notch 3, the cooperation of the pawl tooth 4 with the second closing notch 3 not yet being realized. It will likewise be noted that at this stage the stop 11 of the pawl 9 is still in contact with a surface of the cam 12, so that the cam 12 cannot be displaced under the action of its return spring 18.

In FIG. 11, the instant is illustrated at which the pawl 9 falls back toward the bolt 1, the pawl tooth 4 then cooperating with the second closing notch 3 of the bolt 1. The falling back of the pawl 9 releases the cam 12 by removing the stop 11 from the pawl 9, which results in the displacement of the cam 12 toward its initial position under the action of its return spring 18. The displacement of the cam 12 brings the plunger 20 into contact with a trough of the undulation-shaped or wave-shaped part, so that the plunger 20 occupies its extended position, the switch 19 indicating a change of state interpreted as the indication of the closed lock.

Thus, it is clearly apparent that the indication "closed lock" is here given by the pawl 9, which permits the change of state of the switch 19, via its stop 11 acting upon the cam 12, only at the moment at which the pawl 9 falls back toward the bolt 1, the pawl tooth 4 being in cooperation with the second closing notch 3 of the bolt 1. FIG. 12 illustrates a variant of the cam/switch 12/19 assembly in which the cam 12 henceforth bears a multipolar magnet 22, or reverse polarity magnets arranged side by side, in place of the undulation-shaped or wave-shaped part 21, and the switch 19 then consists of a Hall effect sensor, not represented in FIG. 12. The kinematics, as well as the result of the previously described information on the state of the lock, remain otherwise identical.

FIG. 18 shows an exploded perspective view of all of the same elements discussed above with reference to FIGS. 1-11. More specifically, FIG. 18 is a three-dimensional view which shows how the motor 5 and wheel 7 fit together or operate with the bolt 1, pawl 9 and other lock components.

FIGS. 13 to 17 illustrate a second embodiment of the invention. This second embodiment of the invention essentially differs from the first embodiment of the invention, illustrated in FIGS. 1 to 12, in that the mobile cam 12 is fixed to the pawl 9.

In this second embodiment of the invention, the lock has the following characteristics:

- the mobile cam 12 for actuating the switch is fixed to the pawl 9,
- the lock comprises a fixed guide support 23 capable of guiding the mobile cam 12,
- the bolt comprises two protuberances 24, 25 designed to cooperate with the mobile cam 9.

In fact, as can be seen in FIG. 13, the mobile cam 9 is connected to the pawl 9 and is mounted such that it is freely rotatable relative to the latter 9. The fixing of the mobile cam 9 on the pawl is realized at the level of the boot 10 of the pawl 9, substantially in the upper part of the boot 10. Moreover, in this embodiment, it is not necessary to boast a recess 13 in the housing of the lock, but only a guide support 23 designed to hold the mobile cam 9 and guide it.

Moreover, the bolt 1 comprises on its periphery two protuberances 24 and 25 designed to cooperate with the mobile cam 9. In the example chosen to illustrate the invention, the other elements of the lock according to the second embodiment are identical with those of the lock according to the first embodiment.

The guide support 23 comprises a gently sloping part 27, as well as a crank 28, or offset, such as to cooperate in support with the mobile cam 9, more precisely the free end of the mobile cam 9.

The lock of the second embodiment is illustrated in its closed state in FIG. 17. In the same way as for the first embodiment of the lock, when the motor 5 sets the wheel 7 in rotation, via the motor shaft 6, the pin 8 pushes the pawl 9 counter to its return spring 18, disengaging it from the bolt 1.

FIG. 14 thus illustrates the moment at which the pawl 9 is disengaged from the bolt 1, the latter 1 then being released and being able to turn, under the effect of its spring (not represented), in order to disengage the striker (not represented).

It will be noted that the plunger 20 is depressed when the pawl 9, via its pawl tooth 4, blocks the bolt 1 at the second closing notch 3; the switch thus indicating that the lock is properly closed. As soon as the pawl 9, and its tooth 4, turns in order to release the bolt, the mobile cam 9 is driven by virtue of its connection with the pawl 9. The particular geometry of the mobile cam 9 designed to cooperate with the plunger 20 consists in particular of an offset part 26. Upon the rotation of the pawl 9, under the action of the pin 8, the mobile cam 9 is displaced such that the offset 26 is located opposite the plunger 20, the latter 20 is then released toward its extreme position and the switch 19 changes state, which indicates that the lock is open. FIG. 15 illustrates the lock in the open position, the pawl 9 rests against the bolt 1. It is likewise noted that the free end of the mobile cam 9 rests on the guide support 23.

In the closing kinematics of the lock, initially in the open position as illustrated in FIG. 15, the bolt 1 turns in the opposite direction to the opening kinematics, the mobile cam 9 being guided on the support 23. As can be seen in FIG. 16, when or if the pawl tooth 4' is in contact with the first closing notch 2 of the bolt 1, the mobile cam 9 does not bear upon the plunger 20 owing to the offset 26 of the cam 9, so that the switch 19 does not change state and still indicates the open state of the lock.

On the other hand, when the pawl tooth 4' cooperates with the second closing notch 3 of the bolt 1, the mobile cam 9 bears upon the plunger 20 such as to depress the latter and the switch 19 changes state to indicate the closed state of the lock. This change of state of the switch 19, that is to say the pressure of the mobile cam 9 upon the plunger 20, occurs only at the moment at which the pawl tooth 4' cooperates effectively with the second closing notch 3 of the bolt 1, this by virtue of the particular geometry of the cam 9, in this instance its offset 26.

It is here recalled that the invention is not limited to an electric lock and would have been described in substantially the same way, for both embodiments, in an entirely mechanical lock, that is to say containing no electric motor designed to control or actuate the kinematic chain designed to act upon the pawl. In the case of a mechanical lock, the electric actuator 5, 6, represented in the appended figures, would simply be replaced by a mechanical actuator.

The invention claimed is:

1. A lock housed in a housing, the lock comprising:

a single switch for indicating an "open" or a "closed" state of said lock;

an actuator acting upon a kinematic chain so as to realize the functions of the lock;

a bolt having a first closing notch and a second closing notch;

a pawl comprising a pawl tooth designed to engage with the first or the second closing notch of the bolt; and a cam that is mobile in translation, wherein said cam is displaceable from an initial position corresponding to the lock being in the closed state, wherein the initial position of the cam comprises a position in which the cam buts against a recess of the housing, and wherein the closed state of the lock corresponds to the pawl tooth being in a butting arrangement with the second closing notch of the bolt during an opening phase and a closing phase of the lock, wherein the single switch is activated and deactivated under displacement of the cam, and wherein, during the opening and closing phases of the lock, at least one protuberance associated with both the bolt and the pawl engages with the cam to displace the cam, thereby activating or deactivating the single switch.

2. The lock as claimed in claim 1, wherein during the opening phase of the lock, the at least one protuberance of the pawl engages to displace the cam from the recess of the housing before the protuberance of the bolt engages with the cam, while during the closing phase of the lock, the at least one protuberance of the bolt engages to displace the cam before the at least one protuberance of the pawl.

3. The lock as claimed in claim 1, wherein the cam is accommodated in a recess of the housing of the lock.

4. The lock as claimed in claim 3, wherein the initial position of the cam is the position in which the cam butts against one end of the recess of the housing.

5. The lock as claimed in claim 3, wherein the cam contains a flexible tongue cooperating with a portion of the recess of the housing.

6. The lock as claimed in claim 4 wherein the cam contains a flexible tongue cooperating with a portion of the recess of the housing.

7. The lock as claimed in claim 1, wherein the cam is subjected to the action of a permanent force tending to return said cam into the initial position.

8. The lock as claimed in claim 7, wherein the initial position of the cam is the position in which the cam butts against one end of the recess of the housing.

9. The lock as claimed in claim 1, wherein the switch-actuating mobile cam is fixed to the pawl.

10. The lock as claimed in claim 9, characterized in that it comprises a fixed guide support capable of guiding the mobile cam.

11. The lock as claimed in claim 10, characterized in that the bolt comprises two protuberances designed to cooperate with the mobile cam.

12. The lock as claimed in claim 9, wherein the bolt comprises two protuberances designed to cooperate with the mobile cam.

13. The lock as claimed in claim 1, wherein the single switch comprises a plunger cooperating with a part of the surface of the cam for its activation/deactivation.

14. The lock as claimed in claim 1, wherein the switch consists of a Hall effect sensor and in that the cam comprises a multipolar magnet.

15. The lock as claimed in claim 1, wherein the actuator is an electric actuator.

16. The lock as claimed in claim 1, wherein the actuator is a mechanical actuator.

17. The lock as claimed in claim 1, wherein during the opening phase the pawl cooperates first with the cam, while during the closing phase the bolt cooperates first with the cam.

18. The lock as claimed in claim 1, wherein the switch-actuating mobile cam is fixed to the pawl.

19. The lock as claimed in claim 18, characterized in that it comprises a fixed guide support capable of guiding the mobile cam.

* * * * *